US008978162B2

(12) United States Patent
Hughes et al.

(10) Patent No.: US 8,978,162 B2
(45) Date of Patent: Mar. 17, 2015

(54) CUT RESISTANT GARMENT

(75) Inventors: Griffith W. Hughes, Wayne, PA (US); Jon C. Hughes, Wayne, PA (US); Rayvon A. Morton, Oakboro, NC (US)

(73) Assignees: Banom, Inc., Malvern, PA (US); Ingle Protective Systems, Inc., Concord, NC (US)

( * ) Notice: Subject to any disclaimer, the term of this patent is extended or adjusted under 35 U.S.C. 154(b) by 139 days.

(21) Appl. No.: 12/896,385

(22) Filed: Oct. 1, 2010

(65) Prior Publication Data

US 2012/0079639 A1 Apr. 5, 2012

(51) Int. Cl.
*F41H 1/02* (2006.01)
*A41D 13/04* (2006.01)
(Continued)

(52) U.S. Cl.
CPC ..... *A41D 13/043* (2013.01); *A41D 13/04* (2013.01); *A41D 31/0055* (2013.01); *F41H 1/02* (2013.01); *A41D 15/002* (2013.01); *A41D 2300/32* (2013.01)
USPC ..... 2/2.5; 2/48; 2/51; 2/90; 2/92; 66/175; 66/176

(58) Field of Classification Search
USPC ..... 2/2.5, 463, 46, 48, 50, 49.5, 51, 94, 2/108, 85, 86, 93, 71, 72, 81, 455, 92, 2/462, 456, 457, 95, 96, 102, 103, 90, 77, 2/112–113, 117, 238, 88, 115–116, 120, 2/464, 84, 89, 114; 66/169 R, 170–171, 66/175–177
See application file for complete search history.

(56) References Cited

U.S. PATENT DOCUMENTS 187,405 A * 2/1877 Moulton ..... 2/108
380,576 A * 4/1888 Ives ..... 2/51
(Continued)

FOREIGN PATENT DOCUMENTS

DE 4408142 10/1994
EP 1728442 B1 4/2010
(Continued)

OTHER PUBLICATIONS

Cut Resistant Gloves made with Dyneema, www.dyneema.com/emea/applications/performance-textiles/protective-gloves/gloves-with-dyneema.aspx.*
(Continued)

*Primary Examiner* — Khoa Huynh
*Assistant Examiner* — Brieanna Szafran
(74) *Attorney, Agent, or Firm* — Caesar, Rivise, Bernstein, Cohen & Pokotilow, Ltd.

(57) ABSTRACT

A cut resistant sweater is provided including a chest portion, sleeves, collar, and closure extending from the top edge of the collar through at least part of the chest portion. The closure includes an opening extending from the top of the collar through at least part of the chest portion, and a strip having a first part of a hook and loop fastener thereon. A second part of the hook and loop fastener is disposed on the sweater in at least two pieces, a piece adjacent to a first side of the opening and a piece adjacent to a second side of the opening. The closure is stiff relative to the collar to support the collar. A method for manufacturing the sweater includes providing a cut resistant yarn, and knitting it into a sweater in the order of cuff of first sleeve, first sleeve, body and collar, second sleeve, and cuff of the second sleeve.

3 Claims, 4 Drawing Sheets

(51) Int. Cl.
*A41D 31/00* (2006.01)
*A41D 15/00* (2006.01)

(56) References Cited

U.S. PATENT DOCUMENTS

| | | | | | |
|---|---|---|---|---|---|
| 415,837 | A | * | 11/1889 | Frisbee | 2/51 |
| 1,037,206 | A | * | 9/1912 | Clifford | 2/51 |
| 2,320,783 | A | * | 6/1943 | Lee | 2/94 |
| 2,388,234 | A | * | 11/1945 | Abel | 2/51 |
| 2,389,152 | A | * | 11/1945 | Keeler et al. | 2/458 |
| 3,024,466 | A | * | 3/1962 | Agostini | 2/48 |
| 3,057,178 | A | * | 10/1962 | Konklin | 66/176 |
| 3,191,186 | A | * | 6/1965 | Robertson | 2/51 |
| 3,601,815 | A | * | 8/1971 | Strehlan | 2/48 |
| 3,602,914 | A | * | 9/1971 | Castello | 2/90 |
| 3,691,564 | A | * | 9/1972 | La Marre et al. | 2/458 |
| 3,997,982 | A | * | 12/1976 | Holland | 434/260 |
| 4,467,476 | A | * | 8/1984 | Herbert | 2/2.5 |
| 5,015,251 | A | | 5/1991 | Cherubini | |
| 5,023,953 | A | | 6/1991 | Bettcher | |
| 5,062,159 | A | * | 11/1991 | Jakub | 2/114 |
| 5,088,116 | A | * | 2/1992 | Gould | 2/82 |
| 5,153,941 | A | * | 10/1992 | Grilliot et al. | 2/98 |
| 5,157,792 | A | * | 10/1992 | Allen et al. | 2/2.5 |
| 5,210,877 | A | | 5/1993 | Newman | |
| 5,210,878 | A | * | 5/1993 | Triche | 2/16 |
| 5,343,565 | A | | 9/1994 | Berni | |
| 5,454,119 | A | * | 10/1995 | Thomm | 2/114 |
| 5,625,899 | A | * | 5/1997 | Snedeker | 2/81 |
| 5,887,451 | A | | 3/1999 | Suzuki | |
| 5,924,133 | A | * | 7/1999 | Zapiti | 2/77 |
| 5,956,975 | A | | 9/1999 | Kawashima | |
| 6,044,498 | A | | 4/2000 | Schumann et al. | |
| 6,170,378 | B1 | * | 1/2001 | Neal et al. | 89/36.05 |
| 6,766,666 | B2 | | 7/2004 | Okamoto | |
| 6,934,970 | B1 | * | 8/2005 | Watkins et al. | 2/96 |
| 7,043,766 | B1 | | 5/2006 | Foreman et al. | |
| 7,748,053 | B1 | * | 7/2010 | Hancock | 2/2.5 |
| 2004/0011088 | A1 | * | 1/2004 | Rebouillat et al. | 66/174 |
| 2007/0271965 | A1 | * | 11/2007 | Kolmes et al. | 66/170 |
| 2008/0098503 | A1 | * | 5/2008 | Swartz | 2/458 |
| 2008/0134419 | A1 | * | 6/2008 | Kalaam et al. | 2/463 |
| 2009/0019612 | A1 | | 1/2009 | Schulein et al. | |
| 2009/0061131 | A1 | * | 3/2009 | Monfalcone et al. | 428/35.6 |
| 2009/0235426 | A1 | | 9/2009 | Johnston et al. | |
| 2010/0186138 | A1 | | 7/2010 | Hale | |

FOREIGN PATENT DOCUMENTS

| | | |
|---|---|---|
| FR | 2762483 | 10/1998 |
| GB | 2297022 | 7/1996 |
| WO | 2005116316 A1 | 12/2005 |

OTHER PUBLICATIONS

Gaugliumi, "Knitting Cuff to Cuff: A Dozen Designs for Sideways Knit Garments," Creative Publishing International, Inc., 2007.
International Search Report for corresponding PCT Application No. PCT/US2011/52994, dated Feb. 23, 2012.
Supplementary European Search Report for related European Patent Application No. 11829767.0 dated Feb. 27, 2014.

* cited by examiner

CUT RESISTANT GARMENT

BACKGROUND OF THE INVENTION

This invention relates generally to a protective garment. More particularly, the present invention is directed to a protective garment worn by a person who requires protection from injury by cutting or slashing by broken glass or with other sharp edged articles such as blades, knives, and the like.

Glass handlers, in particular, are often exposed to potential injury and must wear suitable protective clothing. In the past, sweaters were typically knit with two panels, i.e., a front panel and a back panel. These two panels were joined together with an attached sleeve. This type of design leaves an upper shoulder and neck seam. Seams are the weakest part of a cut resistant product.

Numerous patent documents have been directed to cut resistant garments and have been various features thereof. For example, U.S. Pat. No. 7,043,766 (Foreman et al.) is directed to a garment that has indentations forming air channels next to the body of the wearer. One of the yarns is formed from a material such as Kevlar® brand para-aramid synthetic fber to provide cut resistance.

U.S. Pat. No. 6,044,498 (Schumann et al.) is directed to a slash and cut-resistant garment for protecting a person from injury by slashing or cutting with a blade, knife or other sharp edged device. The garment comprises a neck protector attached to a shoulder portion. The neck protector portion uses double knit fabrics or multi-layer fabrics. Foam layers or other materials are disclosed which are used to provide stiffening to keep protection in place on the neck.

U.S. Pat. No. 5,210,877 (Newman) is directed to abrasion and cut-resistant protective clothing for bicycling. The outerwear is constructed with protective fabric panels containing abrasion and cut resistant high performance fibers. The protective panels are structural components and are sewn or otherwise attached to panels or sections of conventional textiles to complete the garment.

U.S. Pat. No. 5,023,953 (Bettcher) is directed to a garment and protective sleeve. A sleeveless sweater has a detachable cut-resistant full length protective sleeve. Shoulder seams are shown in FIG. 1.

International Patent Publication No. WO 2005/1116316, by Wells Lamont Industry Group, is directed to a protective, cut-resistant sleeve and a method of making the sleeve. The sleeve is a tubular sleeve of flexible-cut resistant material made from cut-resistant fiber using a rib type knitting stitch. The rib knit stitch allows greater flexibility in knitting.

European Patent No. EP 1 728 442, by Eckhard Hotz of Germany, is directed to a cut protection garment for preventing injuries when using a chainsaw or saw and includes a first layer of a cut-resistant material and a second layer arranged on the first layer.

All references cited herein are incorporated herein by reference in their entireties.

BRIEF SUMMARY OF THE INVENTION

The present invention is directed to a cut resistant garment having a sweater portion made from a cut resistant material and, optionally, an apron. The sweater portion includes a chest portion, a pair of sleeves, and a collar having a top edge and a bottom edge. The bottom edge of the collar is integral to the chest portion. A closure is provided which extends from the top edge of the collar through at least part of the chest portion. The closure includes an opening extending from the top edge of the collar through at least part of the chest portion, a hook and loop fastener having a first part and a second part, the first part removably attachable to the second part, and a strip having the first part of the hook and loop fastener thereon. The strip preferably has a length generally the same as a length of the opening. A second part of the hook and loop fastener is disposed in at least two pieces, one piece adjacent to a first side of the opening and a second piece adjacent to a second side of the opening. Preferably, the closure is stiff relative to the collar to support the collar.

The apron may be provided that is made from a cut resistant material and is removably attachable to a lower portion of the sweater portion. It is preferably removably attachable utilizing an apron fastener that includes a hook type fastener fabric. The hook type fastener fabric attaches to the cut resistant material of the apron. The apron may include a strip attached at one end of the apron adjacent to an upper edge of the apron. The strip may include a hook type fastener fabric to attach the apron to a user by being disposed around a waist of the user and attaching to loop type fastener fabric adjacent to the upper edge of the apron. The strip may be attached to loop type fastener fabric disposed on the apron adjacent to the upper edge of the apron when not in use by a user to secure the strip to the apron for laundering.

In an alternate embodiment of the cut resistant garment of the present invention, a sweater portion includes a chest portion, a pair of sleeves, and a collar having a top edge and a bottom edge, where the bottom edge integral to the chest portion. A closure extends from the top edge of the collar through at least part of the chest portion. The closure includes an opening extending from the top edge of the collar through at least part of the chest portion. The closure includes a hook and loop fastener providing stiffness relative to the collar to support the collar.

A method for manufacturing a cut resistant garment is also provided, where the cut resistant garment includes a sweater portion having a chest portion, a first sleeve having a cuff, a second sleeve having a cuff, and a collar. The method includes the steps of providing a cut resistant yarn and knitting the cut resistant yarn into a sweater without any exposed shoulder seams. The knitting is accomplished in the order of (a) the cuff of the first sleeve, (b) the first sleeve, (c) the body, (d) the second sleeve, and (e) the cuff of the second sleeve. The order may include knitting the collar at the same time as knitting the body. Alternatively, a separately manufactured collar may be attached to the sweater after the knitting step. Preferably, the knitting steps are performed using a flatbed knitting machine.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
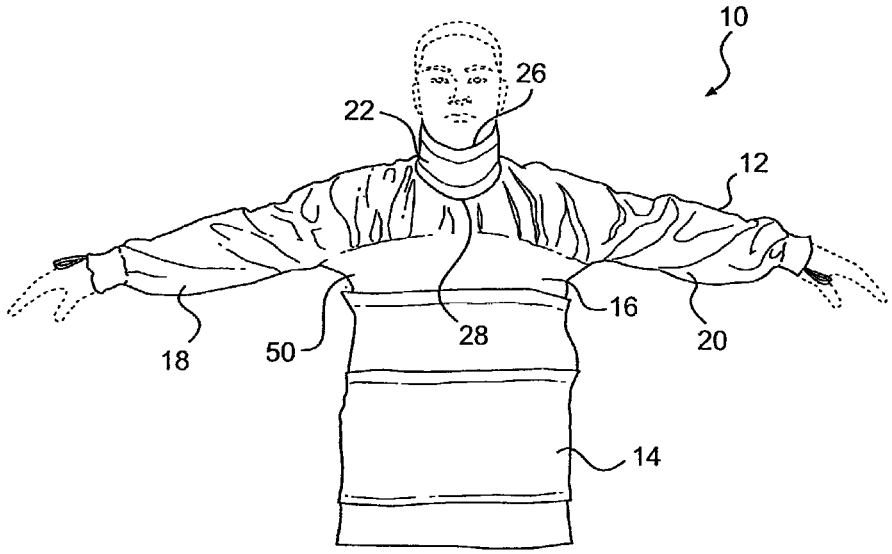
FIG. 1 is a front view of a cut resistant garment in accordance with a preferred embodiment of the present invention.
Figure 2:
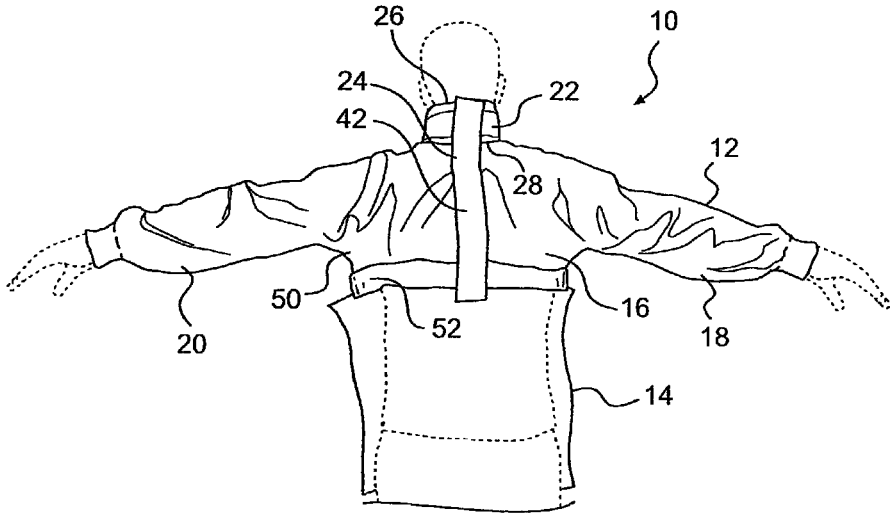
FIG. 2 is a rear view of the cut resistant garment of FIG. 1.
Figure 3:
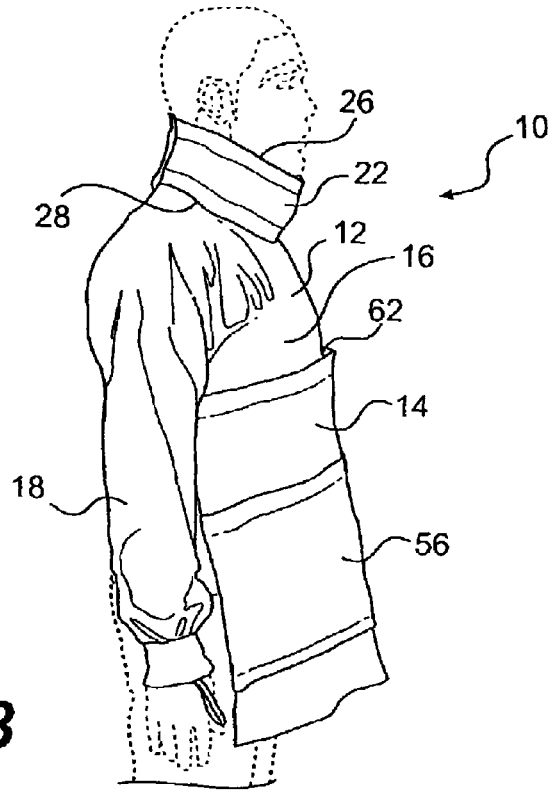
FIG. 3 is a side view of the cut resistant garment of FIG. 1.
Figure 4:
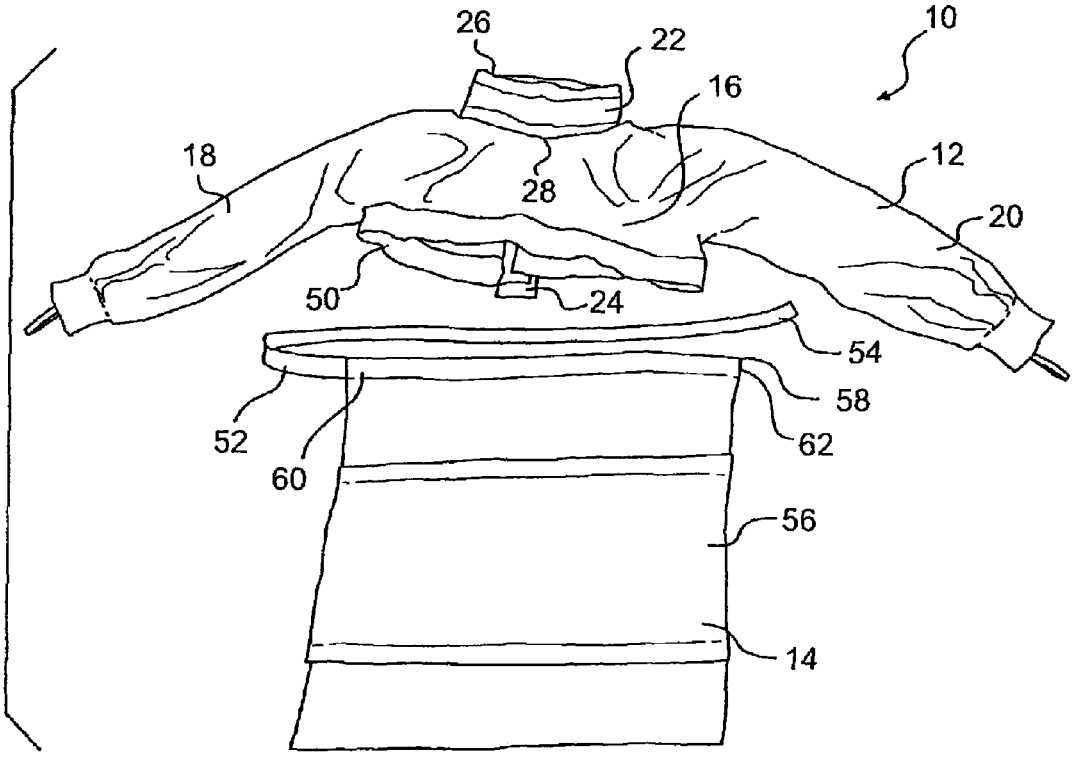
FIG. 4 is an exploded front view of the cut resistant garment of FIG. 1, showing a sweater portion and an apron portion.
Figure 5:
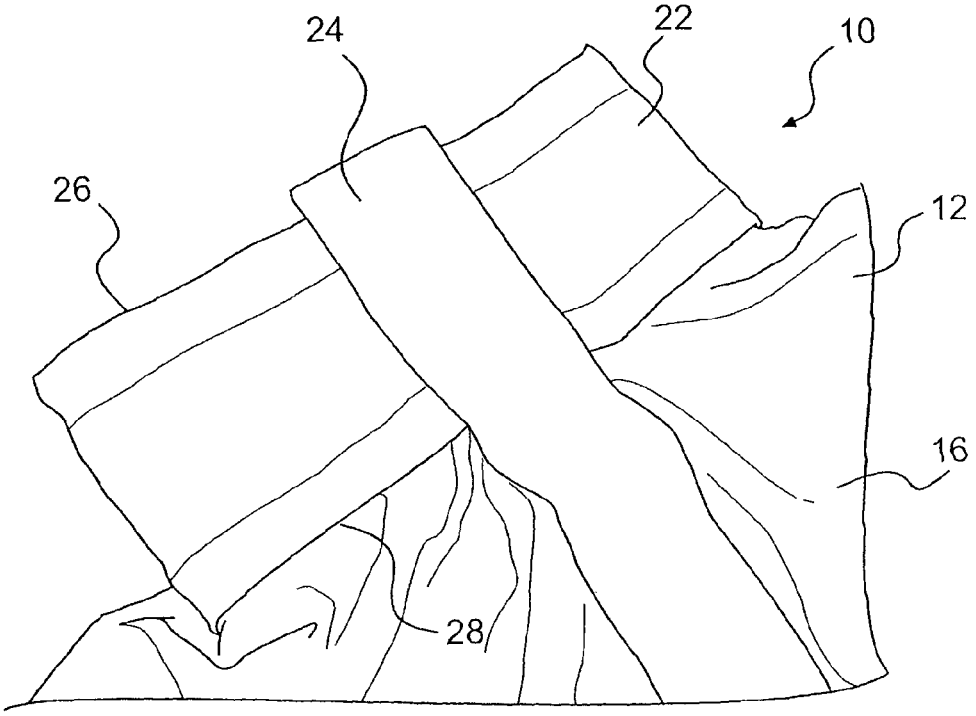
FIG. 5 is a partial rear view of the sweater portion of the cut resistant garment of FIG. 1.
Figure 6:
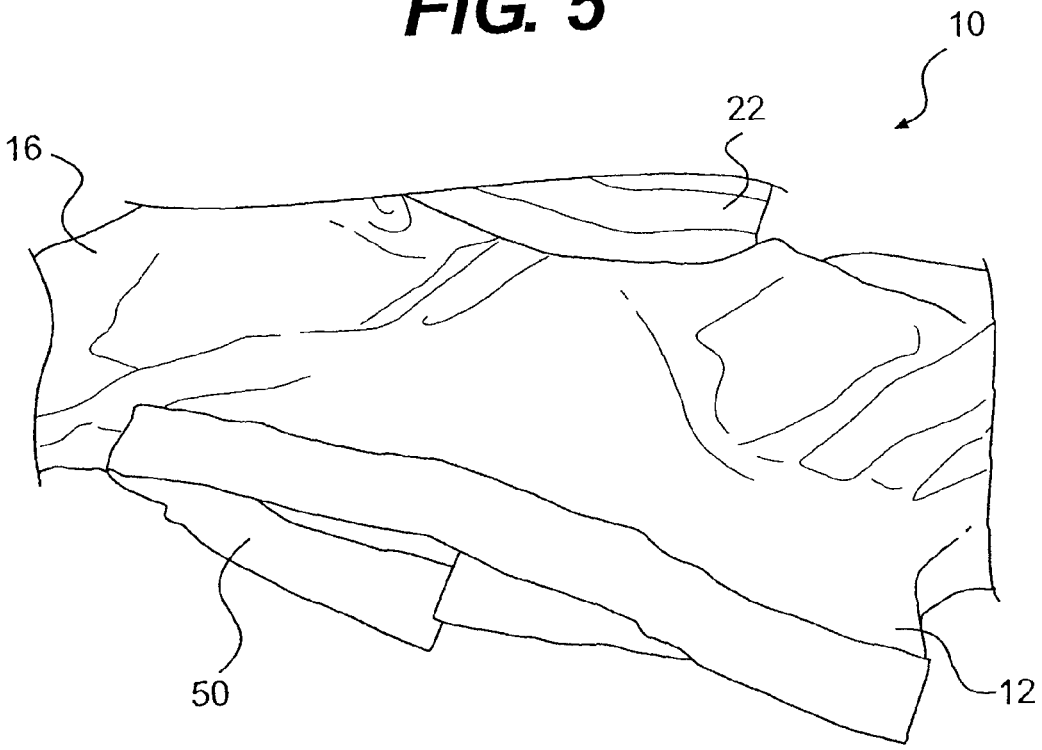
FIG. 6 is a partial front view of the sweater portion of the cut resistant garment of FIG. 1.

The invention will be illustrated in more detail with reference to the following embodiments, but it should be understood that the present invention is not deemed to be limited thereto.

Referring now to the drawings, wherein like reference numbers refer to like elements throughout the several views, there is shown in FIGS. 1-7 a cut resistant garment 10 in accordance with a preferred embodiment of the present invention. The cut resistant garment 10 includes an sweater portion 12 and an apron 14.

The sweater portion 12 includes a chest portion 16, a pair of sleeves 18, 20, a collar 22 and a closure 24. The collar 22 has a top edge 26 and a bottom edge 28. The bottom edge 28 of the collar 22 is integral to the top of the chest portion 16.

The closure 24 extends from the top edge 26 of the collar 22 through at least part of the chest portion 16. The closure 24 includes an opening 30 extending from the top edge 26 of the collar 22 through at least part of the chest portion 16. A hook and loop fastener 32, such as a Velcro® brand fastener, has a first part 34 and a second part 36, one of which includes hooks 38 and one of which includes loops 40, as are well known. The first part 34 is removably and reusably attachable to the second part 36.

Figure 7:
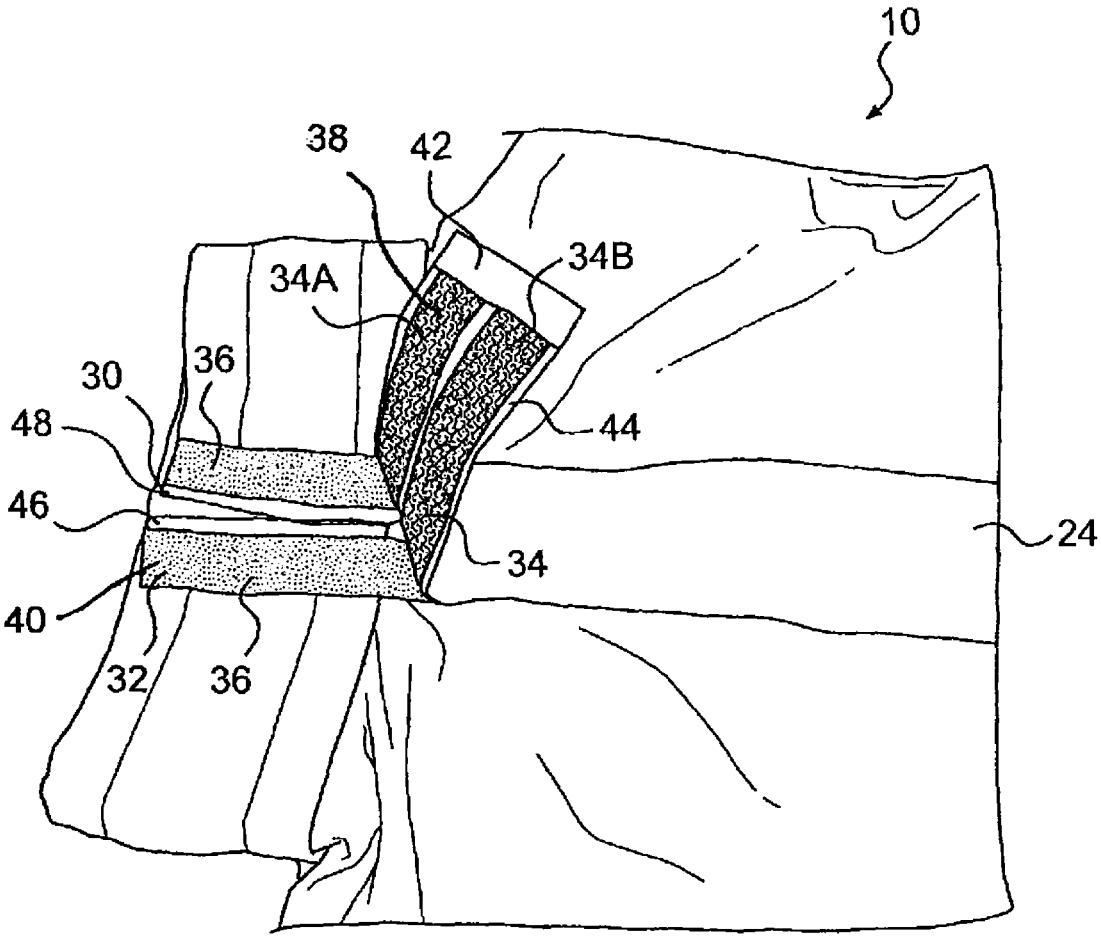
FIG. 7 is a partial rear view of the sweater portion, showing a rear closure in a partially opened condition of the cut resistant garment of FIG. 1.

A strip 42, preferably made from a fabric 44, has a first part 34 of the hook and loop fastener 32, for example, the hook portion, thereon. This first part 34 is not required to be a single piece of hook or loop fabric. For example, as shown in FIG. 7, two strips 34A and 34B, are shown. The strip 42 preferably has a length that is generally the same as a length of the opening 30. The second part 36 of the two part hook and loop fastener 32 is disposed in two strips adjacent to each of a first side 46 of the opening 30 and a second side 48 of the opening 30.

This arrangement, advantageously, provides for a closure 24 which is ambidextrous. That is, the strip 42 can be pulled from either one of the strips adjacent to each of the first side 46 of the opening 30 and the second side 48 of the opening, while remaining secured to the other. The strip 42 can be pulled from the left side or the right side of the sweater portion 12. Preferably, the closure 24 (including the opening 30 and the hook and loop fastener 32) are stiff relative to the collar 22 to support the collar.

The cut resistant garment 10 may further include an apron 14 made from a cut resistant material 56. The apron 14 is attachable to a lower part 50 of the sweater portion 12 via a hook and loop fastener 58. Preferably, only the hook portion is present on the apron 14. The material of the apron 14 serves to function as the hook portion of the fastener. Additionally, a strip 52 of a hook type fastener fabric 54 of a hook and loop type fastener may be used that assists in attaching the apron 14 to a user. The strip 52 is attached to an upper corner 60 of the apron 14, goes around the waist of the user, and attaches back to the apron to loop material 62 on the apron 14. Loop type fastener fabric may be present on the back side of the apron to secure the strip 52 to the apron for laundering.

Preferably, the apron 14 is a knit fabric. This allows the fabric of the apron 14 to stretch ahead of a cutting edge to increase cut resistance. Previous aprons in the prior art used Kevlar® brand para-aramid synthetic fiber twill or leather.

Preferably, all hook and loop fasteners discussed above utilize the loop portion of the fastener on the sweater portion 12 and the apron 14 such that the sweater portion 12 and the apron 14 can be laundered without the hook and loop fastener portions randomly attaching to one another.

Preferably yarn deniers are between about 400 and 2000. The yarn may be, but is not limited to, any combination of high pressure polyethylene (HPPE), fiberglass, polyester, polypropylene and steel, nylon, high tenacity nylon, and the like. Preferably, the knitting machine is a flatbed knitting machine.

Preferably, the apron 14 is made from a knit fabric that is cut resistant. Previous panel designs have been woven fabrics. Knit fabrics stretch in order to add cut resistance and allow individual fibers to twist and roll in the knit fabric for additional cut resistance. Woven fabrics do not offer these benefits.

Importantly, the sweater portion 12 of the cut resistant garment 10 is preferably knit by providing a cut resistant yarn and knitting the yarn into a sweater without any exposed shoulder seams. This is accomplished by knitting in the following unique order. First, the cuff of the first sleeve is knit. Second, the first sleeve is knit. Third, the body is knit. Fourth, the second sleeve is knit. Finally, the cuff of the second sleeve is knit. A step of knitting the collar may occur during the step of knitting the body. Alternatively, a step of attaching the collar, subsequent to the step of knitting the cut resistant yarn into a sweater, may be included. Knit in this manner, the sweater provides safety and strength in the shoulder area because no exposed shoulder seams are present. Moreover, unlike cut resistant garments in the past which utilized two panel construction (front and back), joined with an attached sleeve, the present cut resistant garment drapes properly due to its ability to utilize a tapered design in the armpit area and the unique construction process described here.

The present invention, as shown in the figures, utilizes a closure 24 located on the back side of the sweater portion 12. Use of such a rear closure 24 provides full frontal protection from cuts.

While the invention has been described in detail and with reference to specific embodiments thereof, it will be apparent to one skilled in the art that various changes and modifications can be made therein without departing from the spirit and scope thereof.

What is claimed is:

1. A cut resistant garment, comprising a sweater portion made from a knit, stretchable cut resistant material, said sweater portion comprising:

(a) a chest portion made from the knit, stretchable cut resistant material; the chest portion comprising a front and back section;

(b) a pair of sleeves made from the knit, stretchable cut resistant material;

(c) a collar made from the knit, stretchable cut resistant material, said collar having a top edge and a bottom edge, said bottom edge of said collar integral to said chest portion; and (d) a closure extending from said top edge of said collar through at least part of said back section of said chest portion, said closure comprising:

(i) an opening extending from the top edge of said collar through at least part of said back section of said chest portion;

(ii) a hook and loop fastener having a first part and a second part, said first part removably attachable to said second part;

(iii) a strip having the first part of said hook and loop fastener thereon, said strip being independent to and removable from said collar and said chest portion;

(iv) said second part of the hook and loop fastener disposed in at least two pieces, one of said two pieces adjacent to a first side of said opening when said second part of said fastener is not fastened to said first part of said fastener and one of said two pieces adjacent a second side of said opening when said second part of said fastener is not fastened to said first part of said fastener; and (v) said closure being stiff relative to said collar to support said collar in an upright position to protect the neck of a wearer of the cut resistant garment; and (e) further comprising an apron, said apron made from a cut resistant material and being removably attachable to a lower portion of said chest portion utilizing an apron fastener that utilizes a hook type fastener fabric of a hook and loop type fastener, wherein the apron includes an apron strip attached at one end of an upper edge corner of said apron whereby said apron and said apron strip circumscribe the wearer such that the apron is attached to the front section of the chest portion while the apron strip is attached to back section of the chest portion, said apron strip including the hook type fastener fabric to attach said apron to the wearer by being disposed around the waist of the wearer and attaching to loop type fastener fabric adjacent to an upper edge of the apron, and wherein said apron strip is attachable to the loop type fastener fabric adjacent the upper edge of the apron when not in use by the wearer to secure the apron strip to the apron for laundering.

2. The cut resistant garment of claim 1, wherein said apron strip is disposed horizontally from the upper edge corner of said apron and is attached to the cut resistant material of the apron.

3. The cut resistant garment of claim 1, wherein the garment has no exposed shoulder seams.

* * * * *